US005993257A

United States Patent [19]

Maruyama

[11] Patent Number: 5,993,257

[45] **Date of Patent: *Nov. 30, 1999**

[54] SHIELDED BOARD MOUNTED ELECTRICAL CONNECTOR

[75] Inventor: Shinichiro Maruyama, Ayase, Japan

[73] Assignee: Molex Incorporated, Lisle, Ill.

[ * ] Notice: This patent issued on a continued prosecution application filed under 37 CFR 1.53(d), and is subject to the twenty year patent term provisions of 35 U.S.C. 154(a)(2).

[21] Appl. No.: 08/805,530

[22] Filed: Feb. 25, 1997

[30] Foreign Application Priority Data

Mar. 1, 1996 [JP] Japan ..... 8-071519

[51] Int. Cl.[6] ..... H01R 13/648

[52] U.S. Cl. ..... 439/607; 439/679; 439/108

[58] Field of Search ..... 439/607, 108, 439/677, 678, 681, 679

[56] References Cited

U.S. PATENT DOCUMENTS

| | | | |
|---|---|---|---|
| 4,659,163 | 4/1987 | Athouse et al. | 439/608 |
| 4,710,132 | 12/1987 | Glomb et al. | 439/79 |
| 4,904,194 | 2/1990 | Kilsdonk et al. | 439/681 |
| 4,938,704 | 7/1990 | Fujiura | 439/95 |
| 5,037,330 | 8/1991 | Fulponi et al. | 439/607 |
| 5,163,851 | 11/1992 | Hart et al. | 439/607 |
| 5,174,771 | 12/1992 | Burgit et al. | 439/108 |
| 5,176,526 | 1/1993 | Hillbish et al. | 439/108 |
| 5,199,884 | 4/1993 | Kaufman et al. | 439/74 |
| 5,288,248 | 2/1994 | Chen | 439/609 |
| 5,312,264 | 5/1994 | Thomas et al. | 439/247 |
| 5,344,327 | 9/1994 | Brunker et al. | 439/108 |
| 5,344,341 | 9/1994 | Yoshino | 439/607 |
| 5,356,300 | 10/1994 | Costello et al. | 439/101 |
| 5,387,114 | 2/1995 | Brunker et al. | 439/108 |
| 5,401,187 | 3/1995 | Ortega | 439/567 |
| 5,478,259 | 12/1995 | Noschese | 439/607 |
| 5,479,321 | 12/1995 | Mair et al. | 439/607 |
| 5,509,823 | 4/1996 | Harting et al. | 439/607 |
| 5,630,720 | 5/1997 | Kocher | 439/680 |

FOREIGN PATENT DOCUMENTS

| | | |
|---|---|---|
| 0180284 A2 | 10/1985 | European Pat. Off. . |
| 0524358 A2 | 11/1991 | European Pat. Off. . |

*Primary Examiner*—Paula Bradley
*Assistant Examiner*—Tho D. Ta
*Attorney, Agent, or Firm*—James C. Paschall

[57] ABSTRACT

A shielded surface mount electrical connector includes a dielectric housing adapted for mounting to a surface of a circuit board and includes a mating portion. A metallic shield is mounted on the housing over at least part of the mating portion thereof. The shield includes at least two integral grounding pins structured to provide polarization for the connector on the board. The pins thereby perform the dual function of grounding the metallic shield and polarizing the connector.

11 Claims, 6 Drawing Sheets

SHIELDED BOARD MOUNTED ELECTRICAL CONNECTOR

FIELD OF THE INVENTION

This invention generally relates to the art of electrical connectors and, particularly, to a shielded electrical connector for surface mounting on a printed circuit board.

BACKGROUND OF THE INVENTION

A conventional shielded surface mount electrical connector includes a dielectric (plastic) housing having a plurality of terminal-receiving cavities or passages, with a plurality of terminals received in the passages. A metal shield surrounds a substantial portion of the housing to protect at least the mating portions of the terminals from RF and EMI interference as well as protecting the surroundings from interference radiating from the connector, itself. The housing is mounted to the surface of a printed circuit board, and the terminals have tail portions for surface mounting to circuit pads on the board. In some applications, the housing has no mounting feet or boardlocks extending into holes in the printed circuit board to secure it to the board.

In some systems for using a surface mount electrical connector as described above, the metal shield of the connector is grounded to ground circuit traces on the printed circuit board. In some applications, means are provided for polarizing the connector relative to the board to ensure proper orientation of the connector on the board. In other applications, the connectors are used in pairs, such as mating plug and receptacle connectors, both of which have protective metal shields which are commoned to each other when the connectors are mated. Further, the mating connectors both may be surface mounted to printed circuit boards to provide a board-to-board interconnection. Still other applications have a plurality of connectors mounted to one side of the same printed circuit board, and the connectors are joined by connecting bars or braces.

The present invention is directed to providing various improvements in surface mount electrical connectors, particularly shielded connectors of the character described. For instance, grounding pins on the metal shield of the connector are used to polarize the connector relative to the board, whereby the pins perform an efficient dual function of grounding the shield and polarizing the connector.

SUMMARY OF THE INVENTION

An object, therefore, of the invention is to provide a new and improved shielded surface mount electrical connector for mounting to a surface of a circuit board.

In the exemplary embodiment of the invention, the connector includes a dielectric housing adapted for mounting to the surface of the circuit board and including a mating portion. A metallic shield is mounted on the housing over at least part of the mating portion thereof. The shield includes at least two integral grounding pins for grounding the shield to ground traces on the printed circuit board and to polarize the connector relative to the board.

In one embodiment of the invention, the two integral grounding pins are of different sizes for inserting into complementarily sized holes in the circuit board to provide polarization for the connector on the board. As disclosed herein, the connector is elongated, and two of the differently sized grounding pins are located at each opposite end and on opposite sides of the connector.

In a second embodiment of the invention, the two integral grounding pins are at different nonsymmetrical positions for insertion into complementarily positioned holes in the circuit board to provide polarization for the connector on the board. Again, the connector is elongated, and two of the differently positioned grounding pins are provided at each opposite end and at opposite sides of the connector.

In the preferred embodiment, the dielectric housing is elongated and includes opposite end portions extending longitudinally outwardly from a central mating portion of the housing. The shield includes wing portions juxtaposed over the end portions of the housing. The integral grounding pins project from the wing portions for inserting into complementary holes in the circuit board.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENTS

Figure 2:
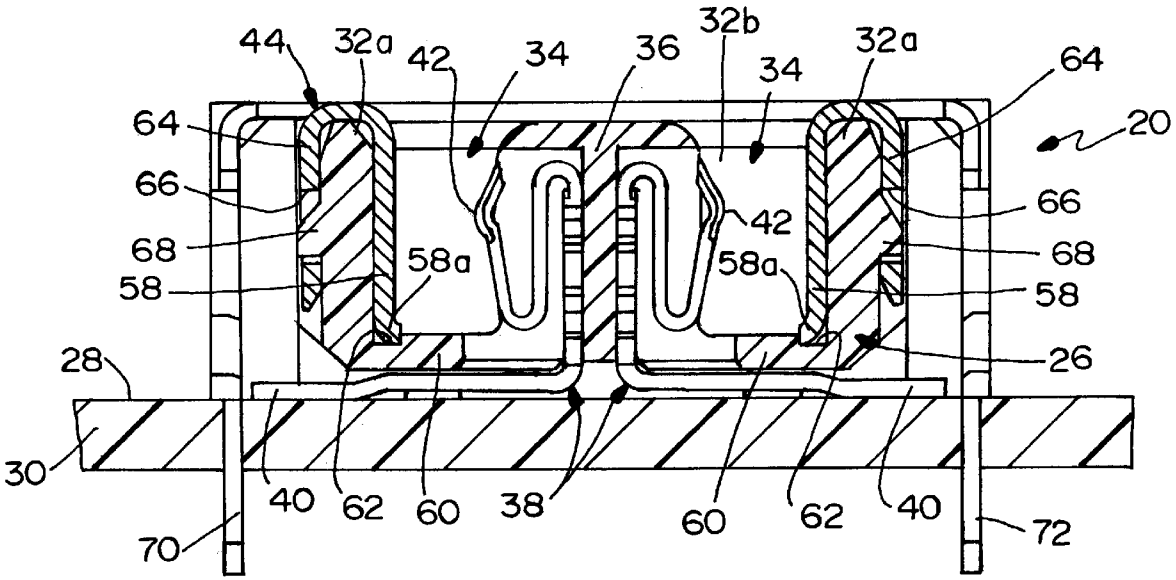
FIG. 2 is a vertical section, on an enlarged scale, taken generally along line 2—2 of FIG. 1.

Referring to the drawings in greater detail, the features of the invention are shown in an electrical connector assembly which includes a receptacle connector, generally designated 20 and a mating plug connector, generally designated 22. Receptacle connector 20 is shown in FIGS. 1–5, and mating plug connector 22 is shown in FIGS. 6–10. An alternate embodiment of a receptacle connector, generally designated 24 is shown in FIGS. 11–14.

More particularly, receptacle connector 20 includes an elongated dielectric housing, generally designated 26, adapted for mounting to a top surface 28 (FIG. 2) of a printed circuit board 30. Housing 26 includes a mating portion defined by a pair of long side walls 32*a* which extend generally parallel to each other in the longitudinal direction of the housing and a pair of short end walls 32*b* which extend generally parallel to each other in the lateral direction of the housing 26. The side and end walls define an elongated plug-receiving slot or receptacle 34 therebetween, the slot being divided longitudinally by a central partition 36.

As best seen in FIG. 2, two rows of terminals, generally designated 38, are mounted in spaced arrays longitudinally of dielectric housing 26. Each terminal 38 includes a tail portion or foot 40 for surface interconnection, as by soldering, to appropriate circuit traces on surface 28 of circuit board 30. The feet 40 of the terminals in each row project laterally outwardly away from the feet of the terminals in the other row on the opposite side of the central partition 36 of the dielectric housing 26. Separating blocks 43 descend from the bottom of the housing between adjacent tail portions 40 to separate the tail portions 40 and support the housing 26. The terminals in the two rows have resilient contact portions 42 which project laterally outwardly into the plug-receiving slot 34 on opposite sides of central partition 36 of the housing.

Figure 3:
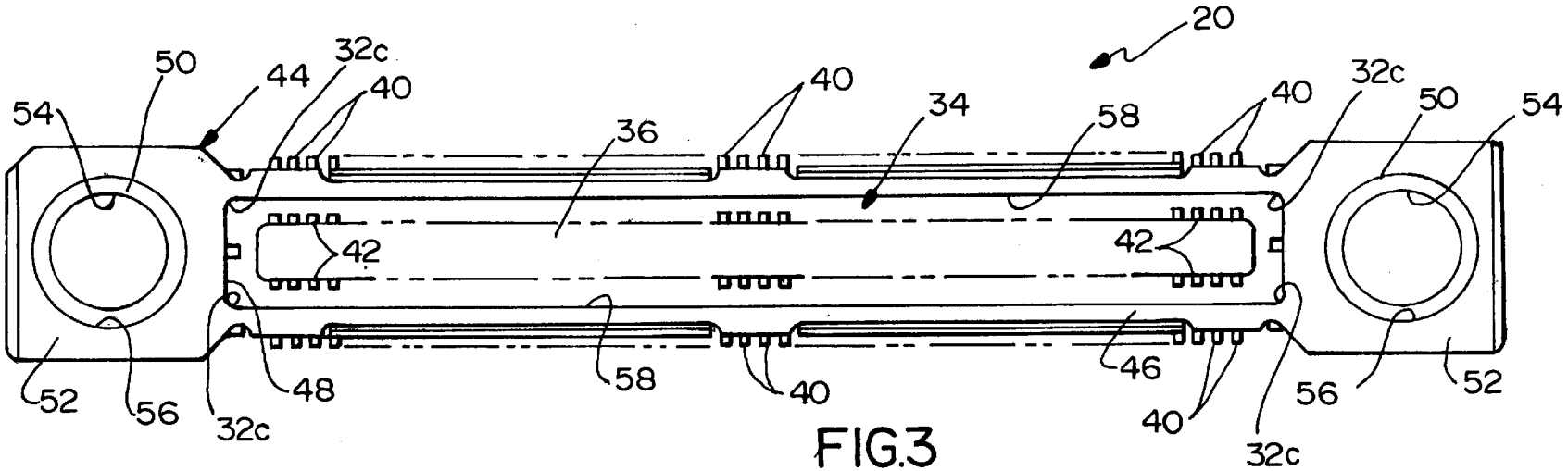
FIG. 3 is a top plan view of the receptacle connector.
Figure 5:
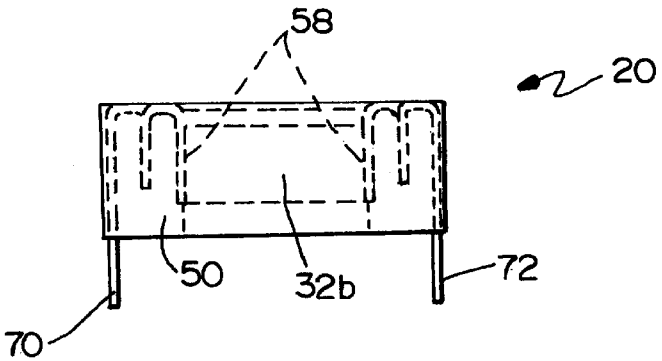
FIG. 5 is an end elevational view of the receptacle connector.

Receptacle connector 20 also includes a one-piece conductive shield, generally designated 44, stamped and formed of sheet metal material. As best seen in FIG. 3, metal shield 44 includes a top flat plate portion 46 which overlies substantially the entire top flat surface of the dielectric housing, except for central partition 36. The shield is provided with an elongated opening 48 (FIG. 3) which coincides with plug-receiving slot 34 of the housing. The housing has opposite ends 50 (FIG. 1) extending outwardly beyond the central mating portion of the housing, and shield 44 has end wing portions 52 (FIG. 3) which overlie end portions 50 of the housing. As seen best in FIG. 3, end portions 50 of the housing include locating holes 54 for purposes described hereinafter, and wing portions 52 of the shield have holes 56 concentric with holes 54 in the housing.

As best seen in FIG. 2, metal shield 44 has plate portions 58 juxtaposed against the inside of long side walls 32*a* and short end walls 32*b* of the dielectric housing. The shield 44 also bends around the corners adjoining the longside walls 32*a* and the short end walls 32*b* to provide a closed loop around the plug-receiving slot 34. Bottom edges 58*a* of the plate portions are disposed above a bottom wall 60 of the housing. The bottom edges of the plate portions are uninterrupted along substantially the entire lengths thereof which run substantially the entire length of the long walls 32*a* and the entire widths thereof which run substantially the entire width of the short end walls 32*b* of the plug-receiving slot 34 as seen in FIG. 3. Consequently, the bottom edges 58*a* of the plate portions 58 comprise a closed loop along the bottom wall 60. The bottom wall 60 of dielectric housing 26 has recessed areas 62 adjacent side walls 32 for receiving bottom edges 58*a* of plate portions 58 of the metallic shield. Therefore, the plate portions cannot deform inwardly into plug-receiving slot 34 where they might interfere with insertion of the plug connector 22.

Figure 1:
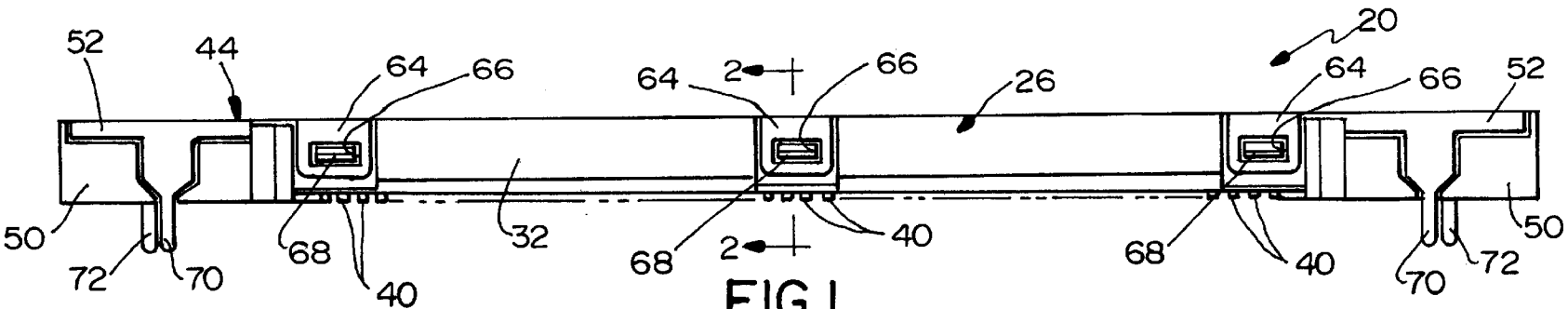
FIG. 1 is a side elevational view of the receptacle connector of the connector assembly according to the invention.

As best seen in FIGS. 1 and 2, the metallic shield 44 has three locking tabs 64 bent over the tops of each long side wall 32*a* and downwardly within respective recesses in the outside surfaces of each long side wall. These locking tabs 64 have holes 66 for snapping over latch bosses 68 projecting outwardly from side walls 32 of the housing to lock the metal shield to the housing.

Figure 4:
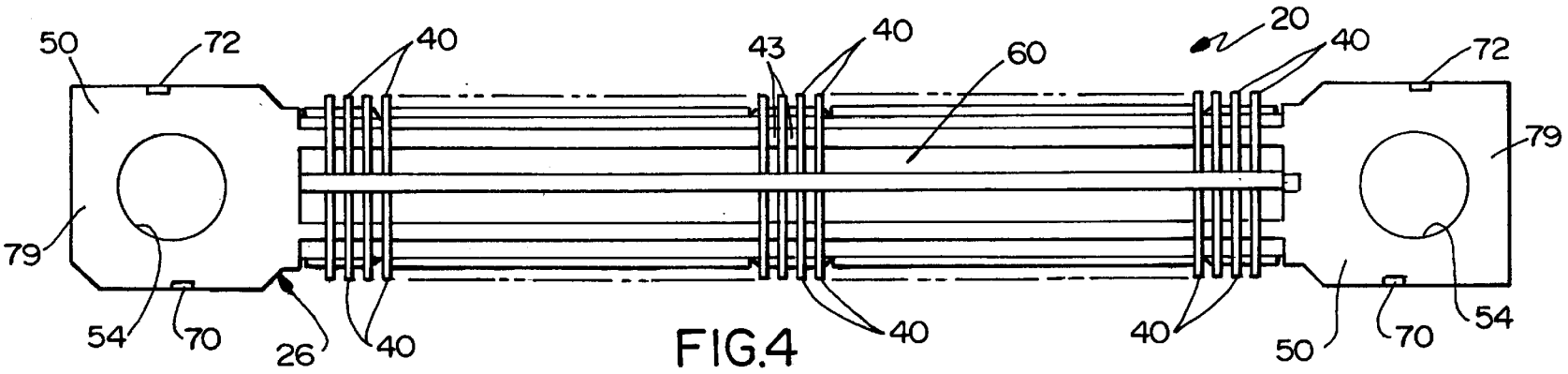
FIG. 4 is a bottom plan view of the receptacle connector.

As best seen in FIG. 1, the wing portion 52 of the shield 44 bend over and nest within respective recesses in opposite side walls of each end 50. Two pairs of integral grounding pins 70 and 72 depending from the wing portions 52 nest within respective recesses in the outside of end portions 50 of the dielectric housing. Referring to FIG. 4 in conjunction with FIGS. 1 and 2, one pair of grounding pins 70 is located on one side of the connector, and the other pair of grounding pins 72 are located on the opposite side of the connector. As seen in FIGS. 1 and 4, grounding pins 70 on the one side of the connector are closer to each other in the longitudinal direction than the grounding pins 72 on the opposite side of the connector. Therefore, with the two pairs of grounding pins being at different nonsymmetrical positions, a polarization feature is provided when the pins are insertable into complementarily positioned holes in circuit board 30. Therefore, grounding pins 70 and 72 perform a dual function of grounding metallic shield 44 of receptacle connector 20 to appropriate ground circuit traces on the circuit board as well as polarizing the connector relative to the board.

Figure 8:
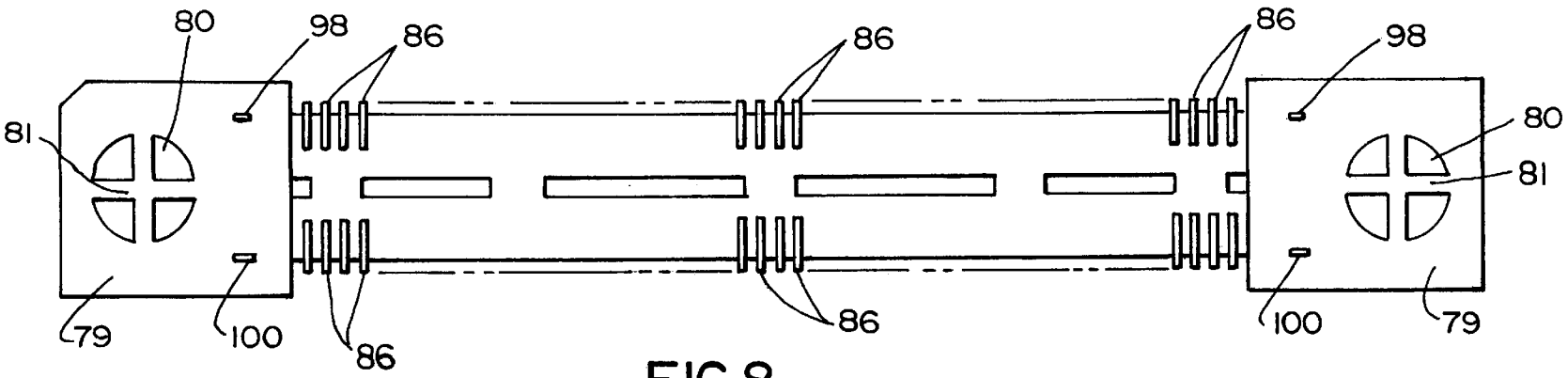
FIG. 8 is a bottom plan view of the plug connector.
Figure 6:
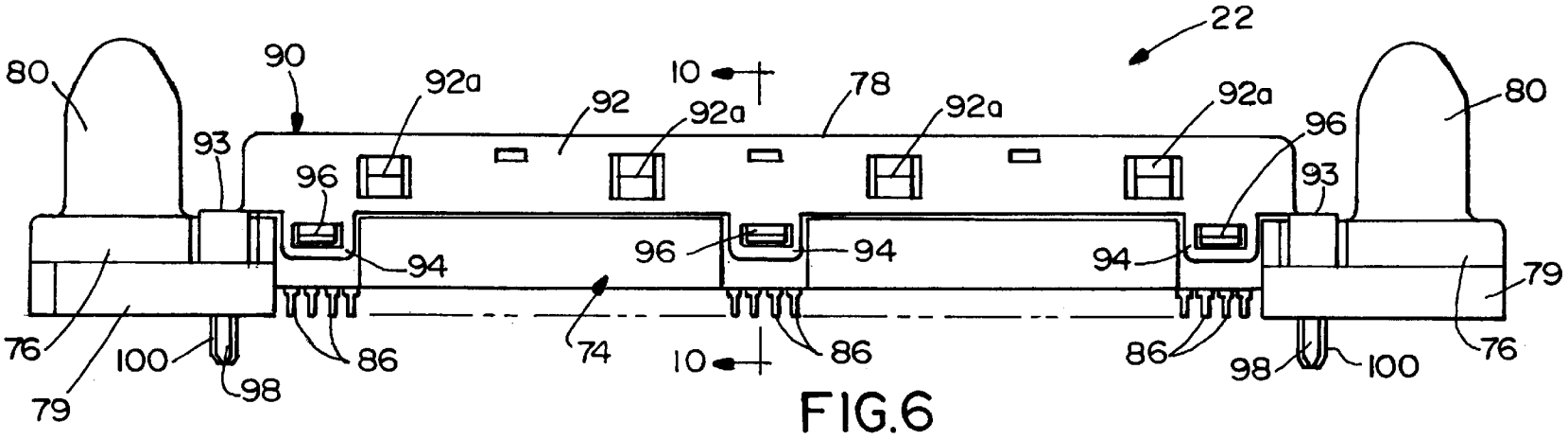
FIG. 6 is a side elevational view of the plug connector of the connector assembly according to the invention.
Figure 7:
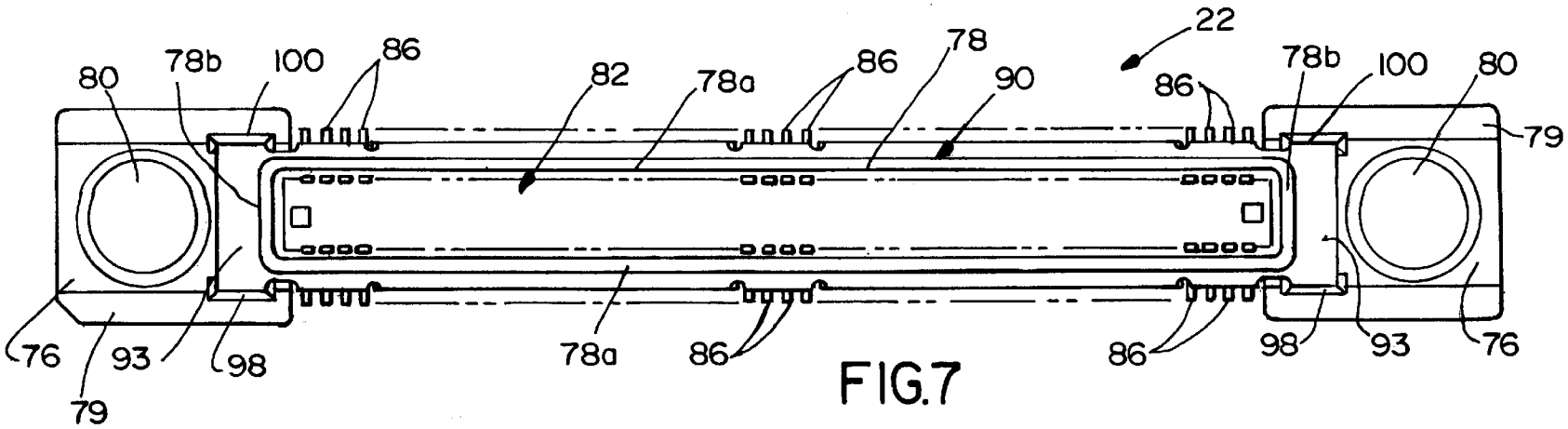
FIG. 7 is a top plan view of the plug connector.
Figure 9:
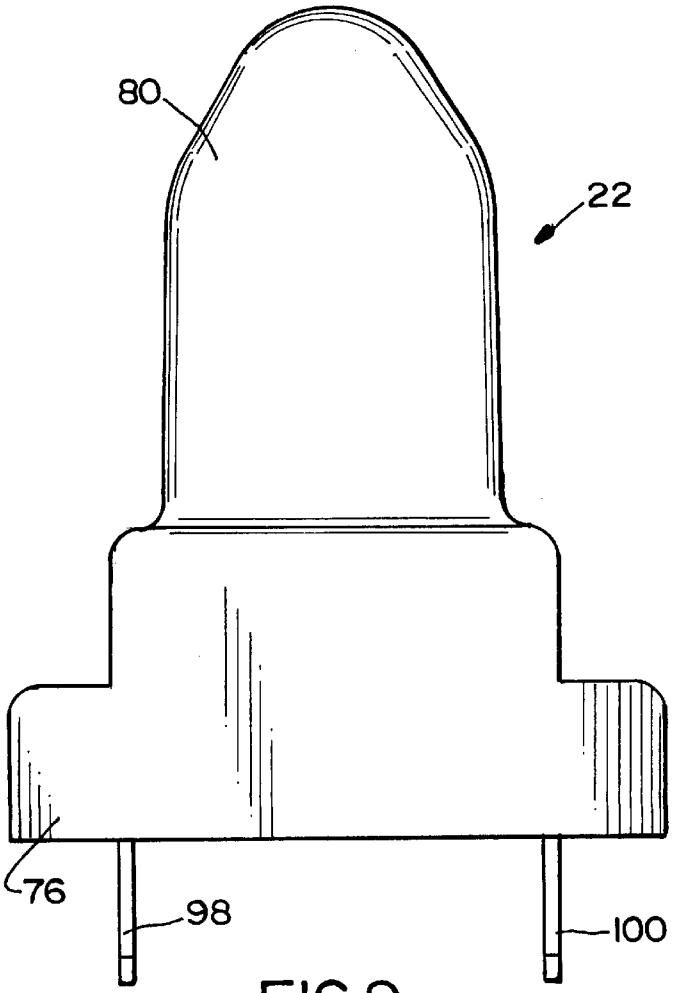
FIG. 9 is an end elevational view, on an enlarged scale, of the plug connector.
Figure 10:
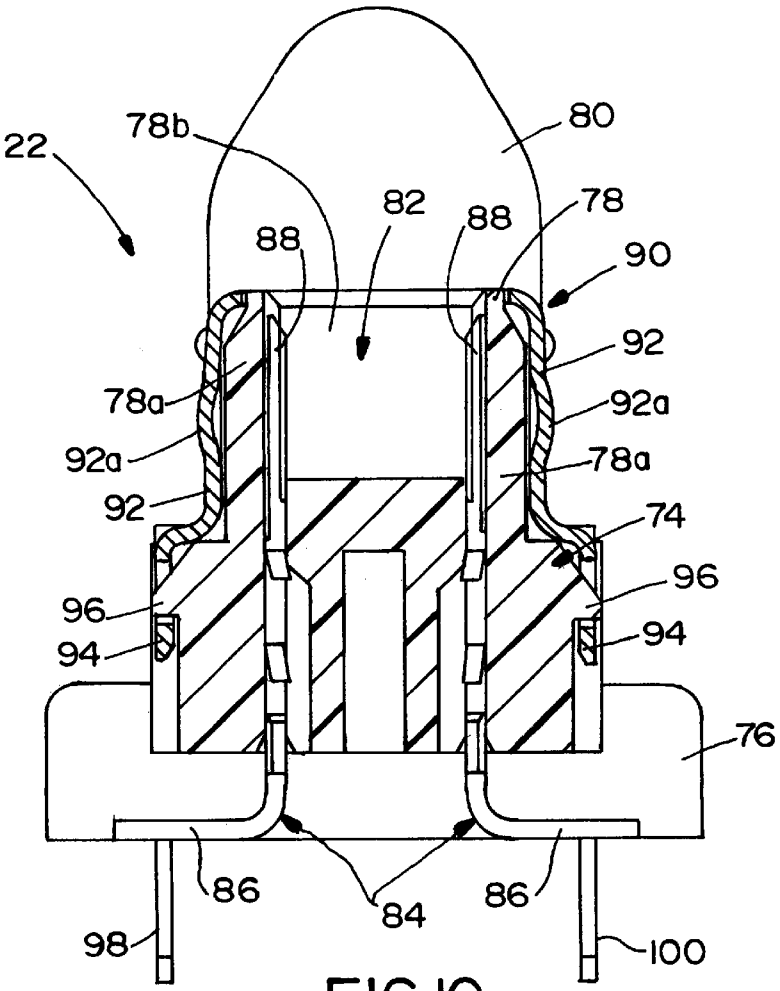
FIG. 10 is a vertical section, on an enlarged scale, of the plug connector, taken generally along line 10—10 of FIG. 6.

As stated above, plug connector 22 is shown in FIGS. 6–10. Like receptacle connector 20, plug connector 22 includes an elongated dielectric housing, generally designated 74, molded of plastic material or the like. The housing includes opposite end portions 76 extending longitudinally outwardly from a central mating portion 78. Each end portion 76 is supported by a base 79 which is wider and lower on the housing than the central mating portion 78. As seen in FIG. 6, a pair of locating posts 80 project from end portions 76 for insertion into locating holes 54 (FIG. 3) of receptacle connector 20. As seen in FIG. 8, the locating posts 80 are hollow and include crossed baffles 81 to prevent the posts 80 from shrinking upon molding. As best seen in FIGS. 7 and 10, the mating portion 78 of plug connector 22 comprises two parallel long walls 78*a* traversed by two parallel short walls 78*b* to define a generally hollow, elongated opening, generally designated 82, for receiving central partition 36 (FIG. 2) and contact portions 42 of receptacle connector 20.

As best in FIG. 10, two rows of terminals, generally designated 84, are mounted in housing 74 of plug connector 22. Each terminal has a tail portion or foot 86 for surface interconnection to circuit traces on a printed circuit board, as by soldering. The two rows of terminals have two rows of contact portions 88 spaced along the inside surfaces of mating portion 78, on opposite sides of opening 82 for engaging resilient contact portions 42 (FIG. 2) of terminals 38 of receptacle connector 20. When plug connector 22 is mated with receptacle connector 20, mating portion 78 of the plug connector is inserted into plug-receiving slot 34 of the receptacle connector, as central partition 36 and contact portions 42 of the receptacle connector enter opening 82 of the plug connector.

The plug connector 22 includes a one-piece metallic shield, generally designated 90, which substantially surrounds the mating portion 78 of the housing 74 of the plug connector. The metallic shield has elongated plate portions 92 (FIG. 6) juxtaposed along the outside surfaces of mating portion 78 as best seen in FIG. 10. The plate portions 92 are juxtaposed along the long walls 78*a* and the short walls 78*b* and bend around the adjoining corners therebetween to define a closed loop as shown in FIG. 7. The plate portions are joined to opposite end wing portions 93 (FIG. 7) juxtaposed over end portions 76 of the housing. Plate portions 92 have convex protrusions 92*a* which provide a positive engagement with plate portions 58 (FIG. 2) of metallic shield 44 of receptacle connector 20 when the plug and receptacle connectors are mated.

Similar to metallic shield 44 of the receptacle connector, metallic shield 90 of plug connector 22 has three locking tabs 94 on each long side which snappingly engage latch bosses 96 on the long walls 78a of the housing 74 as best seen in FIG. 6. This securely fixes the shield to the housing.

Like metallic shield 44 of receptacle connector 20, metallic shield 90 of plug connector 22 has two pairs of integral grounding pins 98 and 100 on opposite sides of the shield and the connector. One pair of grounding pins 98 are located on one side of the connector and the other pair of grounding pins 100 are located on the opposite side of the connector. Each pin 98, 100 descends along the end portion 76 and through a slot in the base 79. As best seen in FIGS. 6 and 8, the grounding pins are in alignment transversely of the connector, but the one pair of grounding pins 98 are narrower than the other pair of grounding pins 100. Therefore, these integral grounding pins of different sizes are insertable into complementarily sized holes in the printed circuit board to provide polarization of the connector on the board. Again, the pins thereby perform a dual function of grounding the metallic shield as well as polarizing the connector.

Figure 11:
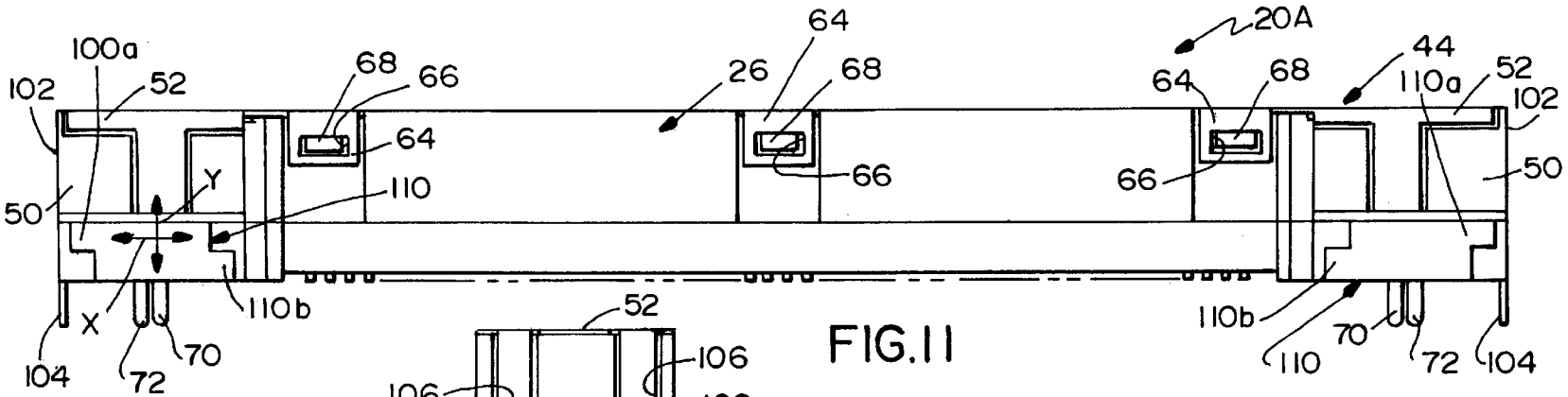
FIG. 11 is a side elevational view of an alternate embodiment of the receptacle connector.
Figure 13:
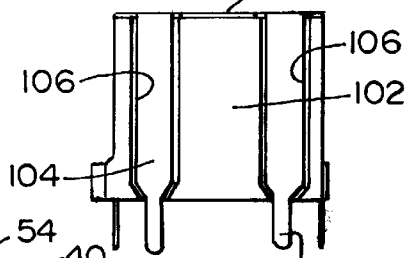
FIG. 13 is an end elevational view of the receptacle connector of FIG. 11.

FIGS. 11–14 show an alternate embodiment of a receptacle connector, generally designated 20A which is generally similar to receptacle connector 20 in FIGS. 15. Therefore, like reference numerals have been applied in FIGS. 11–14 corresponding to like components shown in FIGS. 1–5 and described above. Receptacle connector 20A (FIGS. 11–14) differs from receptacle connector 20 (FIGS. 1–5) in two areas. First, as best seen in FIGS. 11 and 13, dielectric housing 26 has end walls 102 at the extreme opposite ends of the connector. A pair of auxiliary grounding pins 104 are embedded within a pair of slots 106 in each end wall 102 of the housing. Therefore, four additional grounding pins are provided for metallic shield 44 to further enhance the grounding system of the connector assembly.

Figure 14:
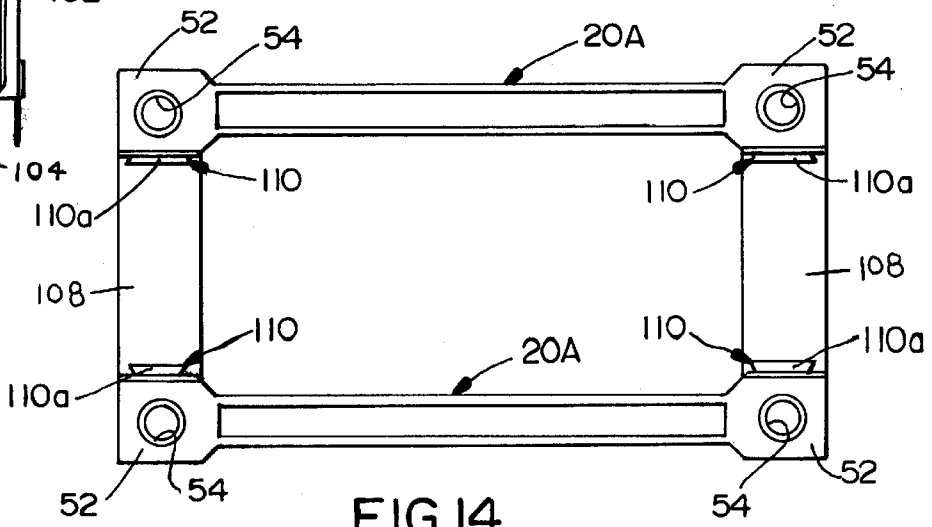
FIG. 14 is a top plan view, on a reduced scale, of a pair of the receptacle connectors of FIG. 11 joined in a parallel arrangement by a pair of connecting bars.

A second difference between receptacle connector 20A (FIGS. 11–14) and receptacle connector 20 (FIGS. 1–5) is the provision of means for facilitating rigidly interconnecting a pair of connectors 20A in a mutually parallel array as shown in FIG. 14. The pair of connectors 20A in FIG. 14 are joined by a pair of connecting bars 108. In order to fix connecting bars 108 between adjacent opposite ends of the two parallel connectors, attachment bosses, generally designated 110, are molded integrally with housing 26 and project from one side thereof at each opposite end portion 50 of the housing. It is contemplated that connecting bars 108 be molded of dielectric material such as plastic or the like, and that the ends of the connecting bars be overmolded about the preformed attachment bosses 110 which are molded integrally with dielectric housing 26. The attachment bosses have a unique configuration to provide support for connecting bars 108 in all directions.

Figure 12:
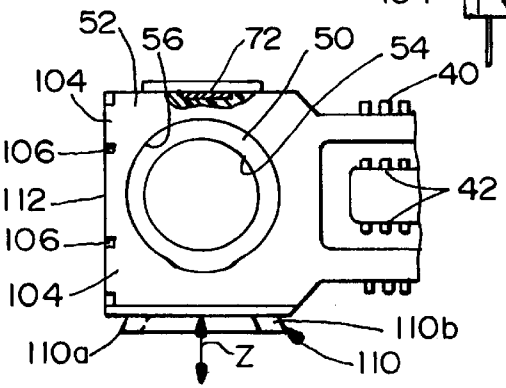
FIG. 12 is a fragmented top plan view of the left-hand end of the receptacle connector shown in FIG. 11.

More particularly, each attachment boss 110 has an upper dove-tail portion 110*a* and a lower dove-tail portion 110*b* as seen clearly in FIGS. 11 and 12. The dove-tail portions are offset longitudinally of the connector.

In order to understand the omni-directional support provided by attachment bosses 110, double-headed arrows "X" and "Y" are shown at the left-hand end of the connector in FIG. 11, and a double-headed arrow "Z" is shown in FIG. 12. Arrow "X" represents the horizontal direction longitudinally of the connector. Arrow "Y" represents the vertical direction. Arrow "Z" represents the horizontal direction transversely of the connector. Therefore, when connecting bars 108 are overmolded about the attachment bosses, the bosses obviously provide support in the horizontal longitudinal direction "X" simply because the attachment bosses project outwardly from the connector. The bosses provide support in the vertical "Y" direction because the dove-tail portions 110*a* and 110*b* are offset horizontally to provide vertical shoulders. The bosses provide support in the horizontal transverse direction "Z" because of the their dove-tailed configuration as seen best in FIGS. 12 and 14.

Therefore, connecting bars 108 are effective to maintain connectors 20A in precise parallel spacing along their entire lengths. With the connectors interconnected by the bars, the connectors can be conjointly mounted on the circuit board.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. A shielded surface mount electrical connector for mounting to a surface of a circuit board, comprising:

a dielectric housing adapted for mounting to the surface of the circuit board and including a mating portion; and a unitary metallic shield mounted on the housing over at least part of the mating portion thereof, the shield including a first integral grounding pin for inserting into a first complementary sized hole in the circuit board and a second integral grounding pin for inserting into a second complementary sized hole in the circuit board, said first integral grounding pin being wider than the second integral grounding pin to provide polarization for the connector on the board and said first and second grounding pins located longitudinally outside of said mating portion.

2. The shielded surface mount electrical connector of claim 1 wherein said grounding pins are located on opposite sides of the connector.

3. The shielded surface mount electrical connector of claim 1 wherein the connector is elongated and said grounding pins are located at opposite ends of the connector.

4. The shielded surface mount electrical connector of claim 1 wherein the connector is elongated and including two of said first and second grounding pins at each opposite end and on opposite sides of the connector.

5. A shielded surface mount electrical connector for mounting to a surface of a circuit board, comprising:

an elongated dielectric housing adapted for mounting to the surface of the circuit board and said housing including side walls and a mating portion; and a metallic shield mounted on the housing over at least part of the mating portion thereof, the shield including at least two integral grounding pins juxtaposed with respective side walls at different non-symmetrical positions on opposite longitudinal sides of the connector for inserting into complementary positioned holes in the circuit board to provide polarization for the connector on the board.

6. The shielded surface mount electrical connector of claim 5 wherein said grounding pins are located on opposite lateral sides of the connector.

7. A shielded surface mount electrical connector for mounting to a surface of a circuit board, comprising:

an elongated dielectric housing adapted for mounting to the surface of the circuit board and including opposite end portions extending longitudinally outwardly from a central mating portion of the housing, said end portions including side surfaces and said central mating portion extending upwardly on the dielectric housing; and a unitary metallic shield mounted on the housing over at least part of the mating portion thereof, the shield including wing portions juxtaposed over the end portions of the housing, and a pair of integral grounding pins extending from each wing portion flushly against said side surfaces of each opposite end portion and pins of each pair being on opposite sides of the connector, each of said grounding pins projecting from each wing portion downwardly with respect to the central mating portion of the dielectric housing for inserting into a complementary hole in the circuit board.

8. The shielded surface mount electrical connector of claim 7 wherein said opposite end portions of the elongated housing include end walls at the extreme opposite ends of the connector, and including at least one of said grounding pins depending along each end wall.

9. The shielded surface mount electrical connector of claim 8, including a pair of said grounding pins at each end wall, the pins in each pair being spaced transversely of the longitudinal direction of the connector.

10. The shielded surface mount electrical connector of claim 9, including a second pair of said grounding pins at each opposite end portion and on opposite sides of the connector.

11. A shielded surface mount electrical connector for mounting to a surface of a circuit board, comprising:

a dielectric housing adapted for mounting to the surface of the circuit board, the housing including a mating portion and upper mating surfaces near both ends of the housing; and a metallic shield mounted on the housing over at least part of the mating portion thereof, the shield including wing portions disposed over said upper surfaces of said housing and at least two integral grounding pins extending from said wing portions longitudinally outside of the mating portion, said grounding pins being structured to provide polarization for the connector on the board, whereby the grounding pins perform the dual function of grounding the metallic shield and polarizing the connector.

* * * * *